US005791182A

United States Patent [19]

Ciani

[11] Patent Number: 5,791,182

[45] Date of Patent: Aug. 11, 1998

[54] METHOD TO CONTROL BETWEEN ROLLING STANDS THE DRAWING OF THE ROLLED STOCK AND RELATIVE DEVICE

[75] Inventor: Lorenzo Ciani, Udine, Italy

[73] Assignee: Ceda SpA Costruzioni Elettromeccaniche e Dispositivi d'Automazione, Buttrio, Italy

[21] Appl. No.: 691,799

[22] Filed: Aug. 2, 1996

[30] Foreign Application Priority Data

May 3, 1995 [IT] Italy ..... UD95 A 00152

[51] Int. Cl.[6] ..... B21B 37/68

[52] U.S. Cl. ..... 72/11.6; 72/8.9; 72/12.7; 72/365.2

[58] Field of Search ..... 72/8.1, 8.3, 8.4, 72/8.6, 8.9, 11.1, 11.2, 11.4, 12.3, 12.6, 12.8, 31.13, 205, 378, 11.6, 11.8, 12.7, 365.2, 274, 278, 282, 289, 291

[56] References Cited

U.S. PATENT DOCUMENTS

| | | | |
|---|---|---|---|
| 4,557,126 | 12/1985 | Niino et al. | 72/205 |
| 4,558,576 | 12/1985 | Reardon et al. | 72/8.9 |
| 4,665,730 | 5/1987 | Maroti | 72/205 |
| 5,305,624 | 4/1994 | Backhous | 72/8.9 |
| 5,495,735 | 3/1996 | Nishimura | 72/8.4 |
| 5,619,880 | 4/1997 | Polster et al. | 72/8.9 |
| 5,628,219 | 5/1997 | Fink et al. | 72/17.2 |

FOREIGN PATENT DOCUMENTS

| | | | |
|---|---|---|---|
| 2652014 | 3/1991 | France | 72/8.3 |
| 3401075 | 7/1985 | Germany | 72/19.8 |
| 4220121 | 1/1994 | Germany | 72/8.1 |
| 60-240321 | 11/1985 | Japan | 72/9.2 |
| 60-240322 | 11/1985 | Japan | 72/9.2 |
| 61-159217 | 7/1986 | Japan | 72/12.7 |
| 0289534 | 3/1990 | Japan | 72/8.3 |
| 8903031 | 7/1991 | Netherlands | 72/8.3 |

*Primary Examiner*—Lowell A. Larson
*Assistant Examiner*—Ed Tolan
*Attorney, Agent, or Firm*—Antonelli, Terry, Stout & Kraus, LLP

[57] ABSTRACT

Method and device to control between rolling stands the drawing of the rolled stock (14) in a segment (10) of a rolling line, the segment (10) possibly comprising two conventional rolling stands with or without an interposed drawing unit (19), a conventional rolling stand and a drawing unit (19), a rolling stand and a fast rolling block (11*a*), two fast rolling blocks (11*a*, 11*b*) with an intermediate thermomechanical treatment or another type of combination of rolling units, there being included a possible intake drawing unit (12) and a possible discharge drawing unit (13) associated with a shears (20), the method including the measuring of the drawing action applied to the rolled stock (14) in the segment between stands comprised between two rolling units, one upstream (11*a*) and the other downstream (11*b*) and/or between a rolling unit and the relative drawing unit (19). The measurement of the drawing action is achieved by a dimensional measuring of a significant dimension of the rolled stock (14) carried out at least two measuring units at at least two points of the segment (10) between stands, at least one of which points is placed immediately at the discharge of the upstream rolling unit (11*a*). The measurements are compared and the result of the comparison correlated to the value of the drawing action exerted on the rolled stock (14).

5 Claims, 1 Drawing Sheet

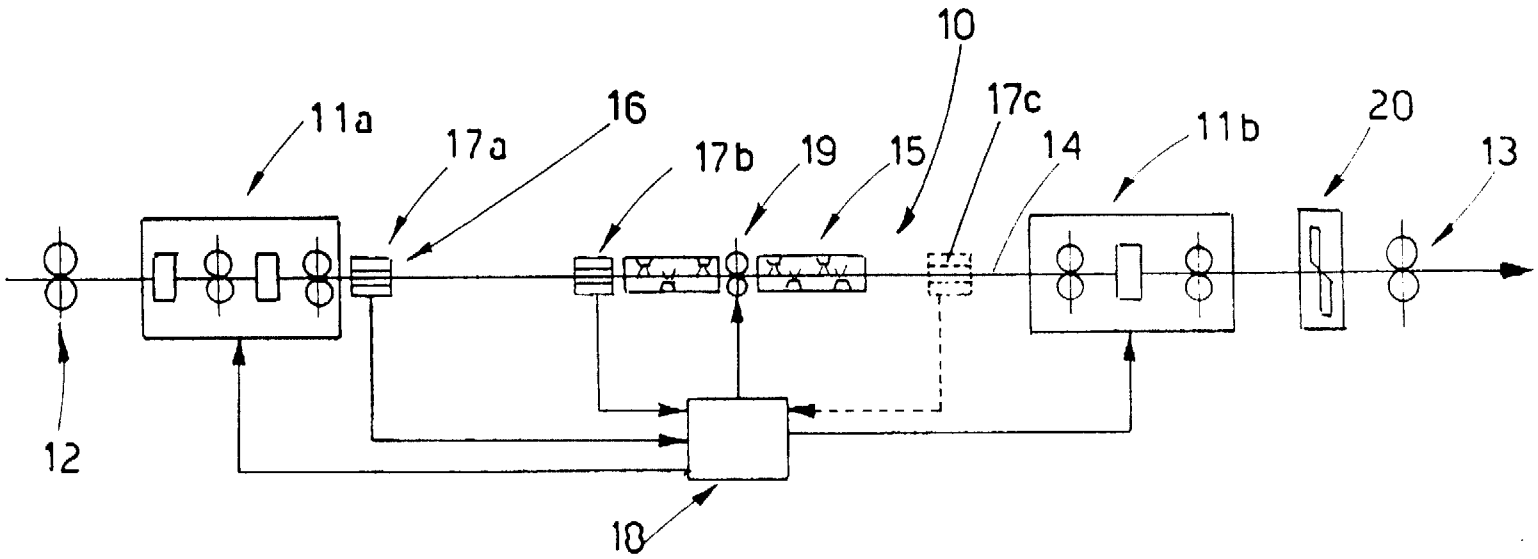
13
20
11b
14
17c
10
15
19
17b
16
17a
11a
12
18

METHOD TO CONTROL BETWEEN ROLLING STANDS THE DRAWING OF THE ROLLED STOCK AND RELATIVE DEVICE

BACKGROUND OF THE INVENTION

This invention concerns a method to control between rolling stands the drawing of the rolled stock and a device which performs such method.

The invention can be applied substantially to any type of rolling and/or finishing process for the purpose of controlling and adjusting the drawing action applied to the rolled stock so as to avoid the formation of critical points and/or deformations along the rolled stock caused by an excessive and/or not uniform and/or not constant drawing action in the long term.

In particular, the invention enables the deformations and reductions of the cross-section of the material to be avoided which could lead to the material not conforming to the finished tolerance of the product and could lead to the obtaining of a finished product having unacceptable characteristics of quality.

One of the great problems encountered in hot-rolling processes, particularly in the production of long products and in plants where the rolling process is carried out directly in line with the casting, is linked to the necessity of maintaining a substantially constant drawing action between the rolling stands so as to avoid the formation on the rolled product of distributed critical points due to deformations and reductions of the cross-section of the material.

These deformations and reductions spread along the rolled product and affect in a non-uniform manner the segment of material between two rolling stands and/or between a rolling stand and the drawing unit associated therewith.

This can cause an unacceptable deterioration of quality in the material and, sometimes, the necessity of discarding a great quantity of product which does not meet the standards of quality required by the market.

This problem is especially great in rolling plants including finishing trains in which a fast cooling and possible temperature-equalisation line is included at least upstream of the last fast rolling unit.

This cooling line has the purpose of carrying out a treatment of a thermomechanical type on the rolled product upstream of the last finishing pass so that the last fast rolling unit can act on colder material and can thus achieve technological and qualitative advantages from the treatment.

This type of process accentuates the above problems due to an irregular and non-uniform drawing action inasmuch as the rolled product in the segment between stands or between a stand and the relative drawing unit includes portions at temperatures which may even be very different.

In particular, the rolled product has a portion upstream of the cooling unit which is hotter and more subject to the consequences of this type of mechanical stresses caused by a drawing action which is not constant and not uniform.

In the state of the art, to solve this problem various methods and devices to control the drawing of the rolled stock between stands have been proposed, but they have given only partial results, not always satisfactory as far as the accuracy and constancy of the results are concerned.

For example, U.S. Pat. No. 4,607,511 teaches that the drawing of the rolled stock between stands is controlled by using a device to measure the diameter of the rolled stock in transit, the device being placed downstream of the rolling stands between which the control must be made.

When there is a deviation from the planned nominal diameter, as revealed by the diameter measuring device, a control unit intervenes and modifies the rotation speed of the rollers so as to modify the drawing action exerted by the rollers and thus reestablish the correct rolling conditions.

The document U.S.'511 also teaches to measure the diameter of the rolled stock upstream of the stands whose drawing action has to be controlled, so as to make the adjustments and interventions of the control unit quicker.

The diameter measurement means arranged upstream and downstream of the rolling blocks makes it possible to detect deviations from the nominal diameter as programmed at the outlet of the rolling blocks, but they do not make it possible to identify how much of this deviation is derived from an incorrect drawing action between the stands, in proportion to the total deviations detected.

This method of controlling the drawing action is therefore extremely influenced and able to be influenced by the working characteristics of the rolling rolls and by all the parameters which can influence the correct definition of the thickness of the rolled stock as it comes out of the block.

The document EP-A-219.316 describes a method to control the drawing of the rolled stock between stands which uses a pinch-roll drawing device arranged between two rolling blocks.

This method to control the drawing action is based on a continual control of the portion of the rolled stock in the segment between the stands with respect to the initial setting parameters defined as the material enters the stand.

According to this verification, and keeping constantly under control the speed of the rollers of the two rolling blocks and the pinch-roll in between, a control unit intervenes to adjust at least the speed of the rollers of the rolling block downstream in order to reestablish the correct conditions if there are unacceptable deviations.

This method, as it provides a periodic control and comparison with parameters defined with conditions prevailing when the rolled stock enters the stand, cannot be used in the case of rolling and casting in line and therefore its field of application is limited specifically to the case of conventional discontinuous rolling of billets; moreover, it has been shown to be imprecise and inconstant in the results it gives.

The document JP-A-089-124 describes a method to control the tension by means of detecting, at a defined point of the segment between the stands, the dimensional pulsations of the portion of rolled stock which are caused by yields in the material caused by an excessive drawing action, the pulsations being recorded by a diameter measuring device.

If the dimensional pulsations exceed a tolerated level, JP'124 teaches to intervene on the rotation speed of the rollers of the downstream stand in order to reestablish the correct rolling conditions.

The document GB-A-1.043.556 includes a device between the stands to control the tension of the rolled stock passing through, continually controlling the transverse dimension.

SUMMARY OF THE INVENTION

The present applicants have designed, tested and embodied this invention to overcome the shortcomings of the state of the art and to achieve further advantages.

The purpose of the invention is to provide a method and the relative device to measure the drawing action applied to the rolled product in the segment between rolling stands in a rolling line, advantageously but not necessarily applied in plants where the rolling line is placed in line with the continuous casting machine.

This invention can be applied at an intermediate position between two conventional rolling stands, between two rolling stands between which is located a drawing unit, between a rolling stand and the relative drawing unit, between a rolling stand and a fast rolling unit, between two fast rolling units with or without an intermediate thermomechanical treatment, and in any other suitable situation in which a rolled product is drawn between two or more processing units.

The invention is particularly suitable in the case of two fast rolling blocks, which are respectively a fast semi-finishing block and a fast finishing block, in a finishing train which includes an intermediate cycle of thermomechanical treatment.

The invention arranges to act on the working parameters of the processing units which exert the drawing action on the rolled stock if, according to the measurement of a definite portion of the rolled stock placed between the two units, it is found that the drawing action itself exceeds the desired limits and/or induces in the rolled stock longitudinal deformations which exceed pre-set limit values.

The invention comprises at least one measurement device able to measure the value of the drawing action exerted on the rolled stock.

This measurement device is associated with a control unit which acts in feedback on the working parameters of the downstream and/or upstream processing units so as to keep this drawing action within pre-set limits.

According to the invention, the measurement device comprises at least two detecting devices, arranged in the segments between the rolling units, to detect the most significant dimension of the rolled stock passing through.

The presence in the segment between the stands of two dimensional detecting devices, to detect for example the diameter, or section, or any other desired significant linear dimension, makes it possible to detect the dimensional variations in the rolled stock which occur in the section between one measuring device and the other.

In particular, it is advantageous to dispose a first dimensional detecting device immediately at the discharge of the upstream rolling unit and a dimensional detecting device immediately in the inlet of the downstream unit.

When there is a unit for thermomechanical treatment placed between the two rolling units, the invention includes arranging at least the first detector immediately at the discharge of the upstream unit and a detector immediately at the intake of the unit for thermomechanical treatment.

According to a variant of this embodiment, there is also a dimensional detector between the thermomechanical treatment unit and the rolling unit downstream.

The presence of at least two dimensional measurements in the segment between the stands makes it possible to have extremely precise information on the state of tension of the rolled stock determined by the drawing action exerted.

In fact, by measuring the dimension of the rolled stock as soon as it is discharged from the upstream unit, a value extremely close to the nominal value is obtained because the state of tension just applied has not yet caused any appreciable deformations.

The purpose of the measurement taken by the second detector is to obtain a value which is more affected by the deformation induced, in that the rolled stock has remained for a longer period of time in a state of tension.

The two or more measurements taken of the rolled stock in the segment between the stands are compared, and from this comparison is given the effective value of the deformation induced by the drawing action exerted in the segment between the stands.

This value therefore is not influenced by deviations and tolerances of the real diameter compared with the nominal diameter which are not the direct consequence of the drawing action, as happens when only one measurement is taken in the segment between the stands or outside the stands.

BRIEF DESCRIPTION OF THE DRAWINGS

The attached figure is given as a non-restrictive example and shows the application of the invention in its preferred embodiment, in the case of a thermomechanical treatment interposed between two fast rolling blocks.

DETAILED DESCRIPTION OF THE PREFERRED EMBODIMENTS

The reference number 10 in the attached figures denotes a segment of a rolling line comprising at least fast rolling blocks 11*a*, 11*b*.

The segment of rolling line can equally well comprise conventional rolling stands, or combinations of conventional stands and fast rolling blocks.

Downstream of the second fast block 11*b* there is a shears to cut to size 20 and a discharge drawing unit 13, while upstream of the first block 11*a* there is an intake drawing unit 12.

Between the semi-finishing fast block 11*a* and the finishing block 11*b* there is a cooling device with jets of water 15 which performs a desired thermomechanical treatment of the rolled stock 14.

The cooling device 15 using jets of water is structured with two blocks, between which is positioned a drawing unit 19.

In this case, between the first fast block 11*a* and the second fast block 11*b* there is a measurement device 16 to detect the extent of the drawing action exerted on the rolled stock 14 between the two blocks 11*a*, 11*b*.

The measurement means 16 is associated with an actuation and control unit 18, which has the appropriate means to intervene in feedback on the working parameters of the block 11*a* and/or block 11*b*, and, to be more exact, on the motors driving the rolling rolls if the drawing action thus measured does not correspond to the pre-set values, so that there are not induced in the rolled stock 14 excessive deformations and reductions of cross-section outside the pre-set limits, and/or if the drawing action thus measured takes on characteristics which are not uniform and constant in the long term.

In the example shown, the measurement device 16 is composed of two units to measure a significant dimension of the rolled stock 14, respectively a first unit 17*a* placed immediately at the discharge of the semi-finishing fast rolling block 11*a* and a second unit 17*b* placed immediately at the intake of the cooling device 15 with jets of water.

The first unit 17*a* serves too obtain the dimensional measurement of the rolled stock 14 which is nearest to the nominal value in that the state of tension, just applied, has not yet caused appreciable deformations.

The second unit 17*b* is placed at he intake of the cooling device with jets of water 15, in the nearest position possible to it, compatibly with the operating limits applying, in order to obtain the measurement in the section of the rolled stock 14 which is most affected by the deformations induced by being on average hotter, and therefore more subject to deformations, and by having remained for a longer period of time in a state of tension.

The two measurements thus obtained are sent to the actuating and control unit 18, which compares the two so as to obtain the real variation generated by the deformation induced by the drawing action, and not by deviations and tolerances of the real diameter with respect to the nominal diameter.

If this variation exceeds a certain tolerated value, it means that the drawing action exerted on the rolled stock 14 is not correct; therefore the actuating and control unit 18 intervenes in feedback on the driving parameters of the rolling units 11*a*, 11*b* until from the comparison of the dimensions it is clear that the drawing action on the rolled stock 14 has been brought back to within the correct values.

According to a variant, there is also one or more units 17*c* to detect the diameter of the rolled stock 14, placed between the cooling device 15 with jets of water and the fast finishing block 11*b*, advantageously in a position near the intake of the fast block 11*b* which is downstream.

I claim:

1. Method to control the drawing of rolled stock in a segment of a rolling line, the segment comprising a rolling unit and a drawing unit or comprising two rolling units, the method comprising measuring the drawing action applied to the rolled stock in the segment between stands comprised between two rolling units, one upstream and the other downstream and/or between a rolling unit and the relative drawing unit, the measurement of the drawing action being achieved by means of a dimensional measurement of a significant dimension of the rolled stock carried out in at least two points of the segment between stands or between the rolling unit and the drawing unit, at least one of which points is placed immediately at the discharge of the upstream rolling unit, the measurements being compared and the result of the comparison being correlated to the value of the drawing action exerted on the rolled stock and, if the result exceeds a tolerated value, correcting the working parameters of the drawing unit and/or the downstream and/or upstream rolling units so as to maintain the drawing action on the rolled stock at a desired value which remains constant in the long term.

2. Method as in claim 1, in which, when there is a thermomechanical treatment interposed between the upstream rolling unit and the downstream rolling unit, at least a second dimensional measurement is taken immediately upstream of an intake to the intermediate thermomechanical treatment.

3. Device to control the drawing of rolled stock in a segment of a rolling line, the segment comprising a rolling unit and a drawing unit or comprising two rolling units, the device being characterised in that there is also included at least between the upstream rolling unit and the downstream rolling unit and/or the drawing unit a measurement device to measure the drawing action imparted to the rolled stock in the segment, the measurement device comprising at least two measurement units for measuring the most significant real dimension of the rolled stock as it passes through, of which at least the first measurement unit is arranged immediately at the discharge of the upstream rolling unit, the measurement device being associated with an actuation and control unit comprising means to correlate at least the two dimensional measurements to the value of the drawing action exerted on the rolled stock and means to correct in feedback the working parameters of the rolling units and/or the drawing unit suitably for the maintaining of a desired and constant value of drawing action in the long term.

4. Device as in claim 3, further comprising thermomechanical treatment provided between the upstream rolling unit and the downstream rolling unit, and the measurement device comprises at least a dimensional measurement unit placed immediately at the intake of the thermomechanical treatment unit.

5. Device as in claim 4, in which the measurement device comprises a dimensional measurement unit cooperating with the intake of the downstream rolling unit.

* * * * *